US007172490B2

(12) United States Patent
Campisi et al.

(10) Patent No.: US 7,172,490 B2
(45) Date of Patent: Feb. 6, 2007

(54) METHOD FOR CALIBRATING A GRINDING MACHINE

(75) Inventors: Gaetano Campisi, Embrach (CH); Manfred Knaden, Zurich (CH)

(73) Assignee: Klingelnberg AG, Zurich (CH)

( * ) Notice: Subject to any disclaimer, the term of this patent is extended or adjusted under 35 U.S.C. 154(b) by 0 days.

(21) Appl. No.: 10/544,583

(22) PCT Filed: Jan. 30, 2004

(86) PCT No.: PCT/EP2004/000887

§ 371 (c)(1),
(2), (4) Date: Apr. 24, 2006

(87) PCT Pub. No.: WO2004/069471

PCT Pub. Date: Aug. 19, 2004

(65) Prior Publication Data

US 2006/0240744 A1 Oct. 26, 2006

(30) Foreign Application Priority Data

Feb. 4, 2003 (DE) ..... 103 04 430

(51) Int. Cl.
*B24B 49/00* (2006.01)

(52) U.S. Cl. ..... 451/5; 451/11; 700/193

(58) Field of Classification Search ..... 451/5, 451/8, 9, 10, 11, 21; 700/161, 164, 192, 700/193

See application file for complete search history.

(56) References Cited

U.S. PATENT DOCUMENTS 3,881,889 A 5/1975 Hunkeler
6,327,790 B1 * 12/2001 Sillon ..... 33/562
6,601,434 B2 * 8/2003 Schaefer ..... 73/1.79
7,103,441 B2 * 9/2006 Engelfried et al. ..... 700/161

FOREIGN PATENT DOCUMENTS

| | | |
|---|---|---|
| DE | 29 46 648 A1 | 5/1981 |
| DE | 101 03 121 A | 8/2001 |
| WO | WO 02/058888 A1 | 8/2002 |

OTHER PUBLICATIONS

Oberlikon: "Operating Instruction"; Oerlikon B24; AAM, Detroit, USA; Machine No. 289820/BT605278; Version: 01.2004.

* cited by examiner

*Primary Examiner*—Jacob K. Ackun, Jr.
(74) *Attorney, Agent, or Firm*—Michaud-Duffy Group LLP

(57) ABSTRACT

The invention relates to a method for calibrating a grinding machine for sharpening bar blades by grinding at least two flanks and a top surface (K) of the bar blades, involving the following steps: producing a calibrating blade by sharpening a bar blade according to predetermined dimensions; measuring the dimensions of the calibrating blade, and; calibrating the machine with the aid of at least the measurement result. In order to produce a calibrating blade, the bar blade is, in at least two steps, ground on the flanks and on the top surface (K) in a complete calibrating grinding. The inventive method is advantageous in that the calibrating blade is ground under the same conditions as a production blade so that process-related influences, in particular, displacements associated with the grinding forces, can also be taken into consideration.

11 Claims, 8 Drawing Sheets

Fig. 1
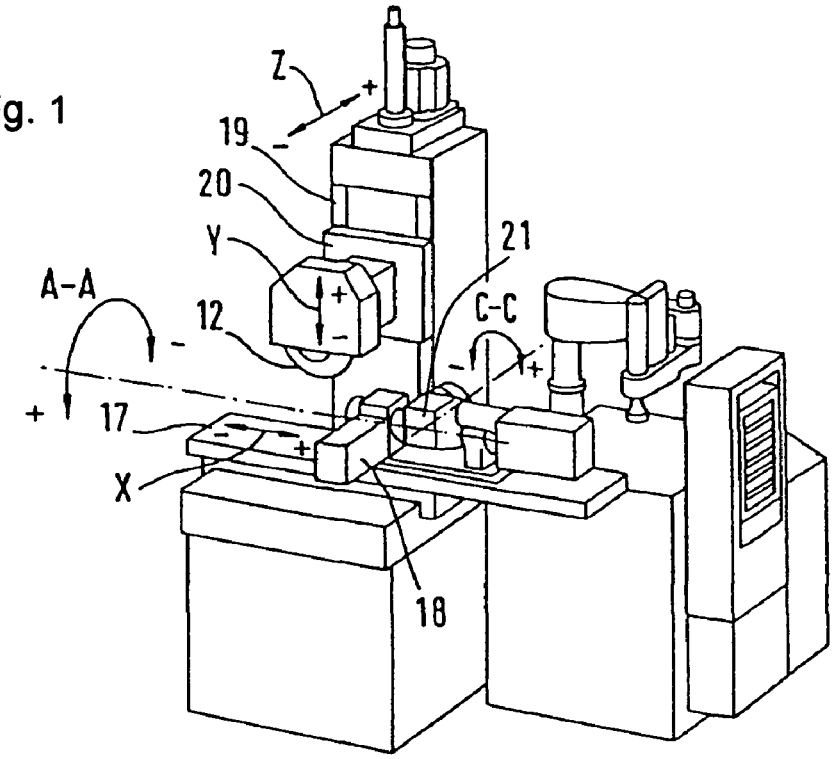
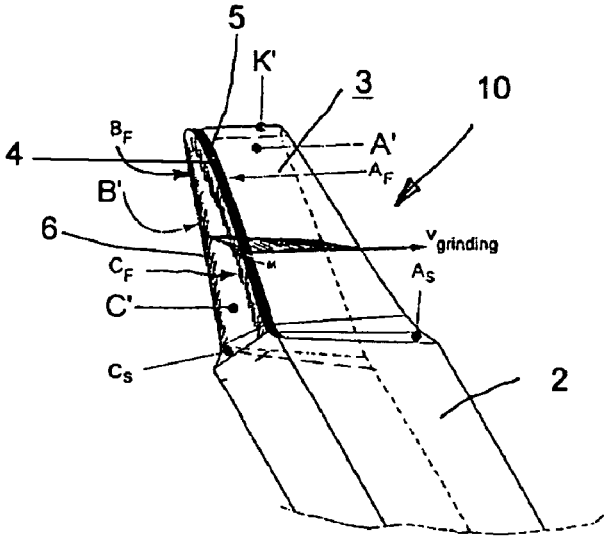
Fig. 2
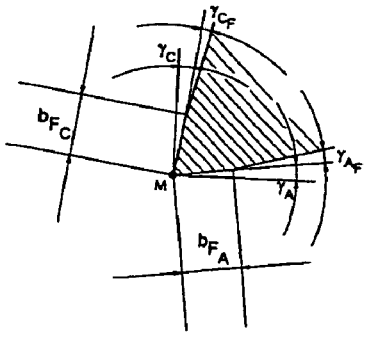
Fig. 3

METHOD FOR CALIBRATING A GRINDING MACHINE

FIELD OF THE INVENTION

This invention relates to a method of calibrating a grinding machine for the sharpening of bar cutting blades by grinding at least two flanks and a top surface of the bar cutting blades.

BACKGROUND OF THE INVENTION

A calibrating method of this type is known from the OERLIKON B24 BLADE GRINDING MACHINE OPERATING INSTRUCTIONS, Date of Issue Mar. 9, 1999/B, Oerlikon Geartec AG, Zurich, which were delivered to VW Kassel together with Machine No. 289839. The contents of these operating instructions (hereinafter briefly referred to as O1) and in particular the parts quoted therefrom in the following are hereby incorporated in the present description by reference in their entirety.

The calibrating method initially referred to has been devised for a grinding machine having 5+1 NC axes of the type shown on page 9 of the O1 and, for greater ease of reference, in the appended FIG. 1. Such a grinding machine is used for sharpening cutting tools, such as a bar cutting blade 10 shown in the appended FIGS. 2 and 3, by means of a grinding wheel 12. The grinding machine has a table 17 on which a slide 18 is adapted to traverse back and forth along an X axis. A column 19 is adapted to reciprocate back and forth along a Z axis at right angles to the X axis. Provided on the column 19 is another slide 20 which is movable back and forth along a Y axis at right angles to the X axis and to the Z axis. The X axis, the Y axis and the Z axis form a rectangular coordinate system. Rotatably mounted on the slide 20 is the grinding wheel 12. Mounted on the slide 18 is a clamping fixture 21 for clamping the cutting blade 10. The clamping fixture 21 is mounted relative to the slide 18 by a positioning axis C—C and a positioning axis A—A normal to the positioning axis C—C. The X axis, the Y axis, the Z axis, the positioning axis A—A and the positioning axis C—C are not only able to position but also to move along CNC controlled curves.

According to appended FIG. 2 the bar cutting blade 10 has a shank 2 of rectangular cross-section and an end 3 essentially trapezoidal in longitudinal section. Provided at the end 3 are a rake surface C, on a left-hand flank 5 when viewing FIG. 2 a secondary clearance surface B extending from the rake surface C rearwardly, on a right-hand flank 6 when viewing FIG. 2 a primary clearance surface A extending from the rake surface C rearwardly, and on the upper end face a top surface K extending from the rake surface C rearwardly. Formed between the secondary clearance surface B, the top surface K, the primary clearance surface A and the rake surface C is a circumferential cutting edge 4. As shown in this Figure, shoulder surfaces A~ and B~, respectively, may be formed in the transition region from the primary clearance surface A and the secondary clearance surface B to the shank 2. Also as shown, a curved shoulder surface C~ may be provided in the transition region between the rake surface C and the shank 2. The primary clearance surface A, the secondary clearance surface B and the rake surface C have each a facet $_{AF}$, $_{BF}$ and CE, respectively. The facet angles amount to about 10 and are designated as $Y_{AF}$, $Y_{BF}$ and $Y_{CF}$, respectively, in the appended FIG. 3 (with $y_{BF}$ being not visible in FIG. 3).

FIG. 4 shows a grinding wheel 12 suitable for grinding the bar cutting blade 10. The grinding wheel 12 has an axis of rotation S to which the grinding wheel is rotationally symmetrical. On one end face the grinding wheel 12 has a circular clamping surface 13 perpendicular to the axis of rotation S. Extending from the outer circumference of the clamping surface 13 is a conical grinding face Pp having a small diameter d1 and a large diameter d2, with the small diameter d1 being provided on the clamping surface 13. Adjoining the large diameter d2 of the conical grinding face Pp tangentially is a curved grinding face 14 of a radius Rs, which merges, again tangentially, with a cylindrical grinding face Ps. The cylindrical grinding face Ps gives way tangentially to a toroidal grinding face G which has a circular-arc-shaped cross-section with a radius of curvature Rg. The toroidal grinding face G extends radially inwardly, merging tangentially with a second conical surface 15 that is undercut relative to the toroidal grinding face G. The grinding wheel 12 is a diamond wheel, with the diamond grains being bonded by electrocoating. In FIG. 4 the position of the grinding wheel 12 (to be more precise: its finishing edge) in the direction of the Y and the Z axis is indicated by pY and pZ, respectively.

Appended FIGS. 5 and 6 show the clamping fixture in a front view and in a top plan view, respectively. The clamping fixture 21 is adapted to rotate about the positioning axis C—C and pivotal about the positioning axis A—A. Adapted to be held in the clamping fixture 21 is a left-hand bar cutting blade 10, as shown, or a right-hand bar cutting blade. The clamping fixture 21 has two stop surfaces 23, 24 for left- and right-hand bar cutting blades, respectively.

To sharpen bar cutting blades on the grinding machine, generation grinding and dual grinding processes are employed. The grinding wheel 12 described also enables form grinding (roughing) followed by generation grinding (finishing) of the surfaces of the bar cutting blade 10 without the need for changing the setup. Conveniently, the grinding wheel 12 rotates about the stationary axis of rotation 5, and the bar cutting blade to be sharpened is guided along the grinding wheel 12 while being adjusted to corresponding angles. The dual grinding process for bar cutting blades and a grinding wheel for carrying out the process are described in WO 02/058888 A 1.

From DE 29 46 648 02 a method of profiling and sharpening bar cutting blades is known which requires only a single pass for a complete grind.

The purpose of the calibrating method initially referred to is to detect deviations resulting from manufacturing and assembly inaccuracies upon a change of the clamping fixture 21 or the grinding wheel 12 and to give consideration, by means of calibration, to both the nominal data forming the basis for calculation and the instantaneous actual condition of the grinding machine when sharpening bar cutting blades. Calibration is also recommended after prolonged use of the grinding wheel, in order to compensate for wear-induced shifts (resulting from increased grinding forces).

Factors relevant for computation of the grinding path are:

relative distance of the two stop surfaces 23, 24 to the positioning axis C—C of the clamping fixture 21 (FIGS. 5 and 6):

stop for left-hand cutting blades (aL)

stop for right-hand cutting blades (aR)

position of grinding wheel 12 (finishing edge) in two axis directions (FIG. 4):

Y axis (py)

Z axis (pZ)

plus: dimensions of the (dual) grinding wheel (FIG. 4):

radius of curvature of the finishing edge (Rg)

distance to roughing face (Ps)

The known calibrating method is described in detail in O1, pages 97–108, reference to which is herewith made to avoid repetitions.

This known calibrating method involves the step of producing a calibrating gage with fixed geometry on three surfaces for the grinding machine and supplying it along with the grinding machine. The three surfaces are the primary clearance surface A, the secondary clearance surface B, and the top surface K. A calibrating blade is ground in the machine in three steps or grinding stages and adjusted to the calibrating gage.

First Grinding Stage

The cutting blade is held clamped in the clamping fixture 21 by means of a gage block. Then the clamping height in the machine is measured (O1 page 100, section 6).

The top surface K is ground and measured in the machine with the cutting blade held clamped (page 103).

The measured value is input in the control unit. It effects a correction in the Y axis (O1, page 104, section 11).

Second Grinding Stage

The bar cutting blade 10 is ground in horizontal position (O1, page 104, section 14). The blade height is again measured in the machine (O1, page 105, section 17). The measured value is again input in the control unit (O1, page 105, section 19).

Third Grinding Stage

The machine grinds the primary clearance surface A or flank 6 and the secondary clearance surface B or flank 5 (O1, page 106, section 21).

The two clearance surfaces A and B are then measured outside the machine (O1, page 106, section 1) and compared with a calibrating gage (a so-called master calibrating blade). The measured values, that is, the deviations, are again input in the control unit. The machine is thus calibrated and set up.

This is a time-consuming method. Measuring in the machine is difficult and requires much practice. In the first two stages (first and second grinding stage) the grinding wheel oscillates over the top surface, which amounts to a grinding operation that does not occur in the production process, that is, the sharpening of bar cutting blades on the grinding machine. Furthermore, the known method necessitates three steps or grinding stages, including the first and the second grinding stage in which the top surface is ground twice to be able to determine the Y and Z component of an error, and a third grinding stage in which the two flanks are ground once to be able to determine the position of the clamping fixture relative to the C—C axis. During the first two steps the cutting blade cannot be removed from the machine for measuring, because in these steps the measurements are taken relative to the machine. With the known calibrating method, therefore, a clamping fixture error can be detected only in the third grinding stage. This means that the first and the second grinding stage may prove redundant in retrospect, because their results are of no use whatsoever because of an initially undetected clamping fixture error. Finally, for the dual method the known calibrating method either lacks sufficient precision or necessitates additional machine equipment.

It is an object of the present invention to provide a method of the type initially referred to in such a manner that it can be performed more easily and produces better results.

SUMMARY OF THE INVENTION

According to the present invention this object is accomplished in a method of the type initially referred to in that the manufacture of a calibrating blade includes the complete grinding of the bar cutting blade at least twice on the flanks and the top surface, and that the measurement of the geometry of the calibrating blade is taken on a measuring device outside the grinding machine.

The method of the invention for calibrating a grinding machine is carried out by means of a calibrating blade which, unlike the known method, is ground in predetermined positions and subsequently measured outside the machine. The measured deviations from the nominal dimensions are input in the NC control unit of the grinding machine where appropriate consideration is given to them. When a production blade is ground, it is likewise measured, outside the machine, but a correction is made only for one axis arrangement (by shifting the blade). The grinding machine itself could not be calibrated by such an individual correction.

Similar to the known method, the calibrating blade which is produced in accordance with the invention is comprised of a rectangular bar on which one top surface K and two clearance surfaces A, B are ground. They combine with the bar front surface to form the cutting edges, and the points of intersection of the top edge with the flanks form the blade tips. The standard grinding process for producing a production blade includes the step of completely grinding a bar cutting blade on the flanks and the top surface once. According to the invention the production of a calibrating blade involves the steps of completely grinding a bar cutting blade at least twice and the taking of measurements outside the machine after each of these two calibrating grinds. Any deviations are input in the machine control unit, similar to the known method. In the method of the invention, the grinding process for the calibrating blade is the same as for a production blade. Therefore, technological peculiarities in the machine enter the grinding result. This is the most significant advantage of the calibrating method of the invention over the known calibrating method. According to the invention, calibrating emulates the production process with geometrically exact arrangement. Also the measurement method is identical to the method used in production. However, in the method of the invention a clamping fixture error, if any, is detected as early as in the first grinding stage, whilst in the known method as late as in the third grinding stage. Further major advantages of the method of the invention are that no measurement at all is taken in the machine, and that the method of the invention comprises only a total of two calibrating grinds, in contrast to the known method which comprises three calibrating grinds. Considering that in the method of the invention the geometry of the calibrating blade is measured on a measuring device outside the grinding machine, the measuring operation is rather adaptable to a production process of bar cutting blades in which measurements are also taken on a measuring device outside the grinding machine.

Advantageous aspects of the method of the invention are the subject matter of the dependent claims.

When in one aspect of the method of the invention each calibrating grind includes two finishing passes, the calibrating blade is finish ground after two complete calibrating grinds.

When in another aspect of the method of the invention the two calibrating grinds involve the step of orienting the bar cutting blade in two axis directions forming an angle of between 70° and 90° and preferably of about 90° with one another in order to determine the position of a working face of a grinding wheel of the grinding machine relative to these two axis directions and the orientation of the bar cutting blade relative to a positioning axis, three errors can be easily eliminated in two steps.

When in a further aspect of the method of the invention the first finishing pass comprises grinding the top surface, a first transition radius to the first flank and the first flank in a single pass, whereupon the bar cutting blade is rotated about the positioning axis through 180 degrees, and the subsequent second finishing pass comprises grinding the top surface, a second transition radius to the second flank, and the second flank, on grinding each flank on each calibrating grind the bar cutting blade advantageously is positioned differently in the grinding machine, enabling an unambiguous conclusion to be drawn from the measured values to the calibration values, resulting in a symmetrical geometry of the calibrating blade for calibration. Owing to the possibility of changing between the right- and left-hand stop from the first to the second calibrating grind, a total of four errors can be eliminated in two steps.

When in yet another aspect of the method of the invention for the first calibrating grind the bar cutting blade is positioned against the end face of the grinding wheel, an error in the direction of the Y axis is readily detectable when in this aspect the cutting blade is placed against the end face of the grinding wheel in such a manner that the A—A axis is as parallel to the Y axis as possible and the stop surface of the clamping fixture is precisely parallel to the X axis. In the first finishing pass, top surface, transition radius and first flank are thus ground in a single pass. When for the second finishing pass the cutting blade with the clamping fixture is rotated about the C—C axis through 180 degrees and the same grinding operation is repeated, the top surface, the transition radius and the second flank are ground.

In this process the grinding wheel is guided in a straight line along the edges so that the top surface is vertical, both flanks are opposite at a predetermined angle (preferably of 20°) to the C—C axis, and the blade tips are spaced from the stop surface by the distances (mA and mB) to be checked.

When in another aspect of the method of the invention for the second calibrating grind the bar cutting blade is swung through an angle of 90 degrees and positioned against the cylinder face of the grinding wheel by swinging the fixture through 90 degrees about the A—A axis, causing the C—C axis to be parallel to the Z axis, an error in the direction of the Z axis can be detected, using otherwise precisely the same procedure as for the first calibrating grind.

When in a further aspect of the method of the invention for determining the radius of curvature of a grinding wheel of the grinding machine, the positioning axis of the bar cutting blade is tilted through the flank angle and the bar cutting blade is completely ground on the flanks and the top surface using a third calibrating grind, the measured deviation yields a third circle point enabling a deviation of the radius of curvature Rg to be computed by a suitable program.

When in another aspect of the method of the invention for calibrating the grinding machine a further step involves the grinding of one of the two flanks of the bar cutting blade only with a roughing face of the grinding wheel whose position is to be determined, the distance to the roughing face Ps can be established through the further step by merely roughing the second flank, without facet angle. In this process the first flank serves a checking function. Evaluation is again done by a suitable program.

When in still another aspect of the method of the invention the step of measuring the geometry of the calibrating blade involves the use of an absolute measuring device, the measurement can be taken by tactile or optical devices in order to measure flank or tip distance deviations (fmA and fmB) upon each grind. Again, a program in the computer of the grinding machine may be used for evaluation.

When in yet another aspect of the method of the invention the step of measuring the geometry of the calibrating blade involves the use of a comparative measuring device that compares the measured geometry of the calibrating blade with the dimensions of a calibrating gage, the process can be speeded up because comparison measurement is usually a quicker and more precise method than absolute measurement, requiring however a calibrating gage that has been previously gaged accurately by absolute measurement.

When in a further aspect of the method of the invention in the steps in which the bar cutting blade is ground in a complete calibrating grind, grinding is performed under the same conditions under which bar cutting blades are sharpened on the grinding machine, the calibrating blade can be ground using the same process as a production blade, which enables consideration to be given also to process-related influences, in particular shifts associated with the grinding forces. By calibrating over three axes (Y, Z, C), not only position and symmetry of the flanks but also abrasion are adjusted on the cutting blade. This makes the cutting blade insensitive to direction variations of the C—C axis. Also, form errors in the tip radius (due to offset of the top edges) and differences in facet abrasion are avoided.

BRIEF DESCRIPTION OF THE DRAWINGS

Embodiments of the present invention will described in greater detail in the following with reference to the remaining drawings.

FIG. 1 is a perspective view of a known grinding machine for sharpening bar cutting blades, which can be calibrated using the method of the invention FIG. 2 is a partial perspective view of a bar cutting blade adapted to be sharpened with the grinding machine of FIG. 1.

FIG. 3 is a partial cross-sectional view of the top end of the bar cutting blade of FIG. 2 to illustrate facet and clearance angles in the region of a cutting edge.

DETAILED DESCRIPTION OF THE PREFERRED EMBODIMENTS

Figure 4:
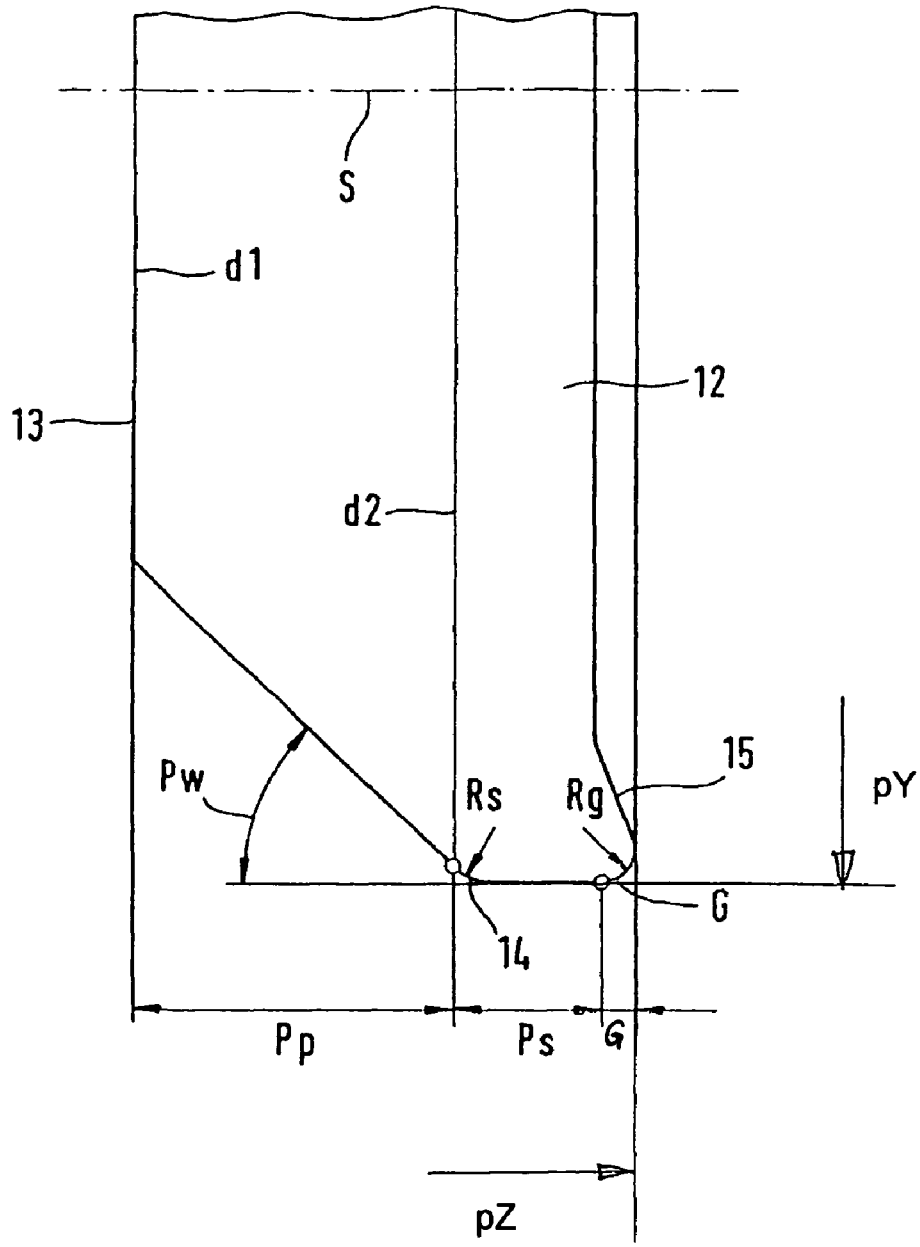
FIG. 4 is a cross-sectional view of a grinding wheel of the grinding machine of FIG. 1.
Figure 5:
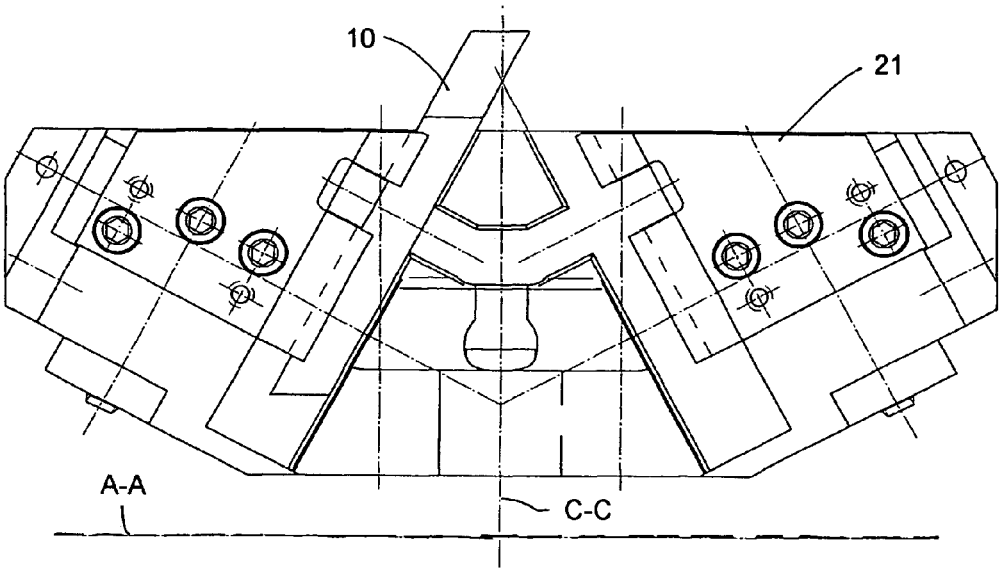
FIG. 5 is a front view of a clamping fixture showing a bar cutting blade held clamped therein.
Figure 6:
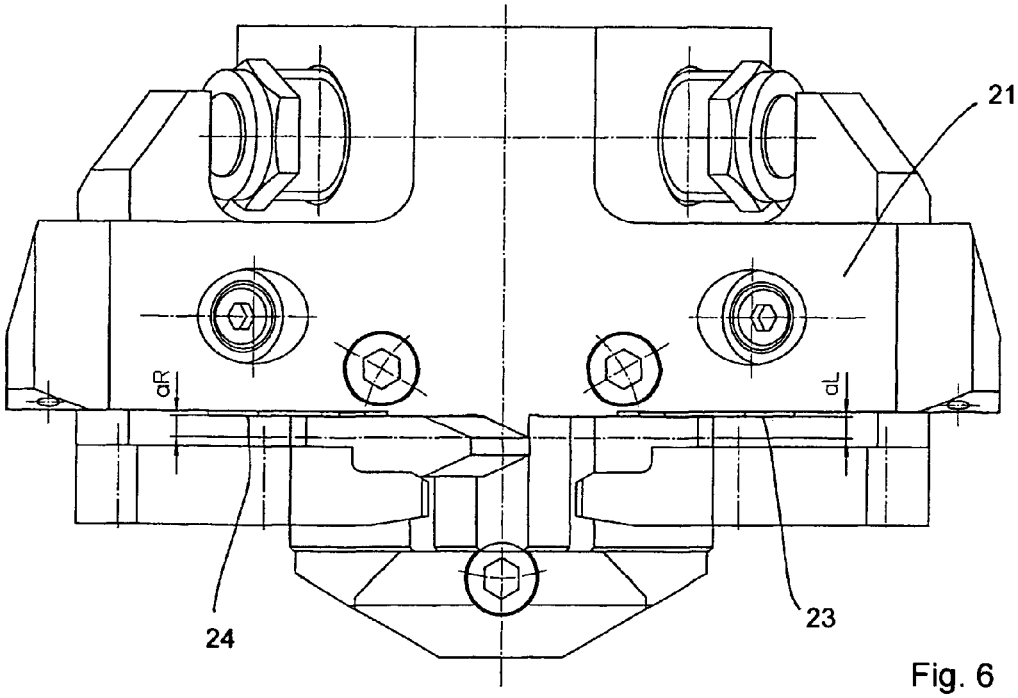
FIG. 6 is a top plan view of the clamping fixture of FIG. 5.
Figure 7:
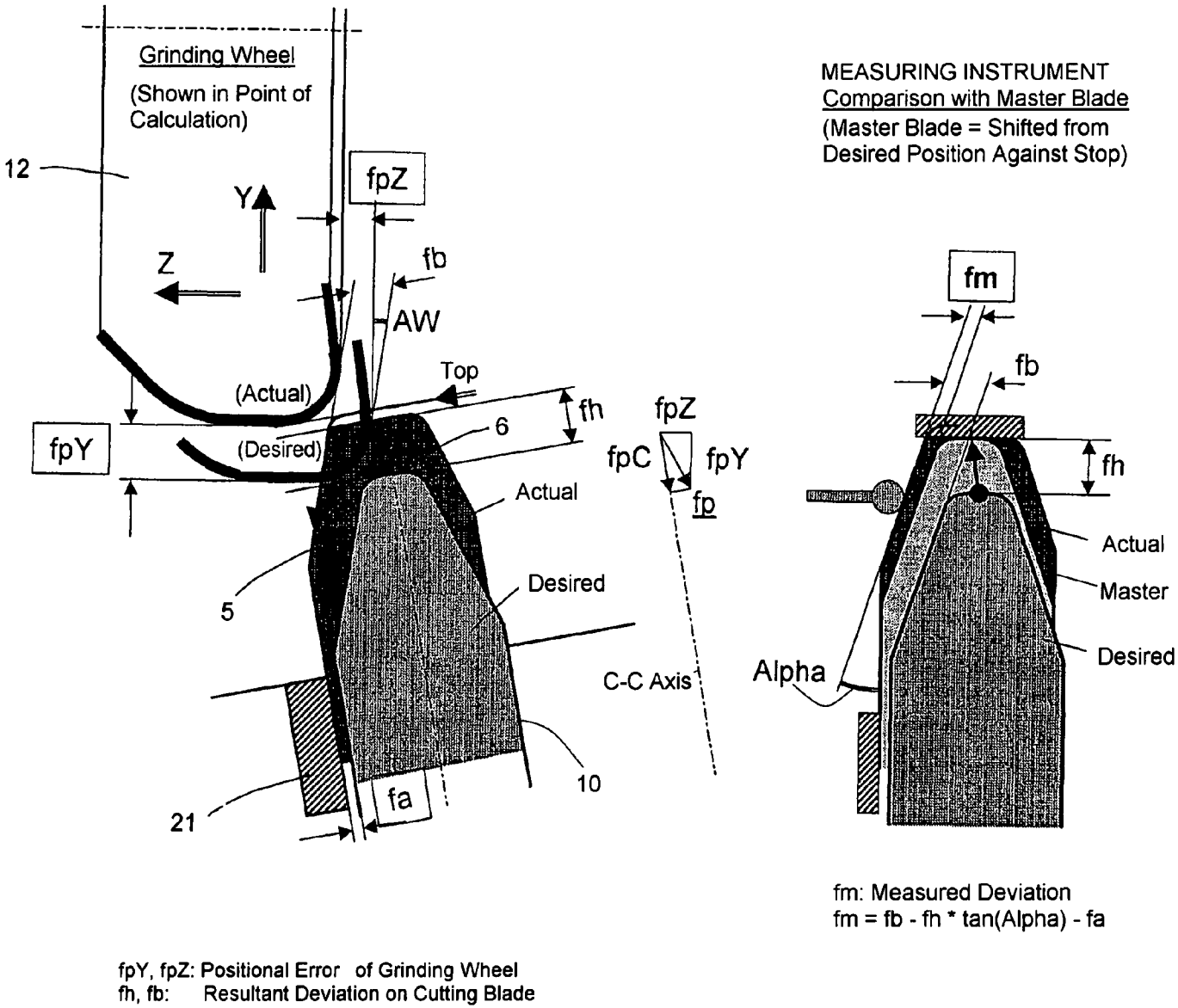
FIG. 7 shows the effect of a positional error of the grinding wheel on a production blade.

When grinding using the generation grinding method as illustrated in appended FIG. 7, position deviations of the grinding wheel (fpY, fpZ) and a stop deviation in the clamping fixture (fa=faL or faR) have an impact on both the flank abrasion (fb) and the abrasion over the top (fh) (including a potential offset of the two top edges). When a comparison measurement is taken, the master blade in the measurement device is shifted from the desired position against the stop (by the amount fh), producing the measured thickness deviation (fm) as superposition of all the errors. Heretofore, this measurement value has been used for correcting the cutting blades.

Figure 8:
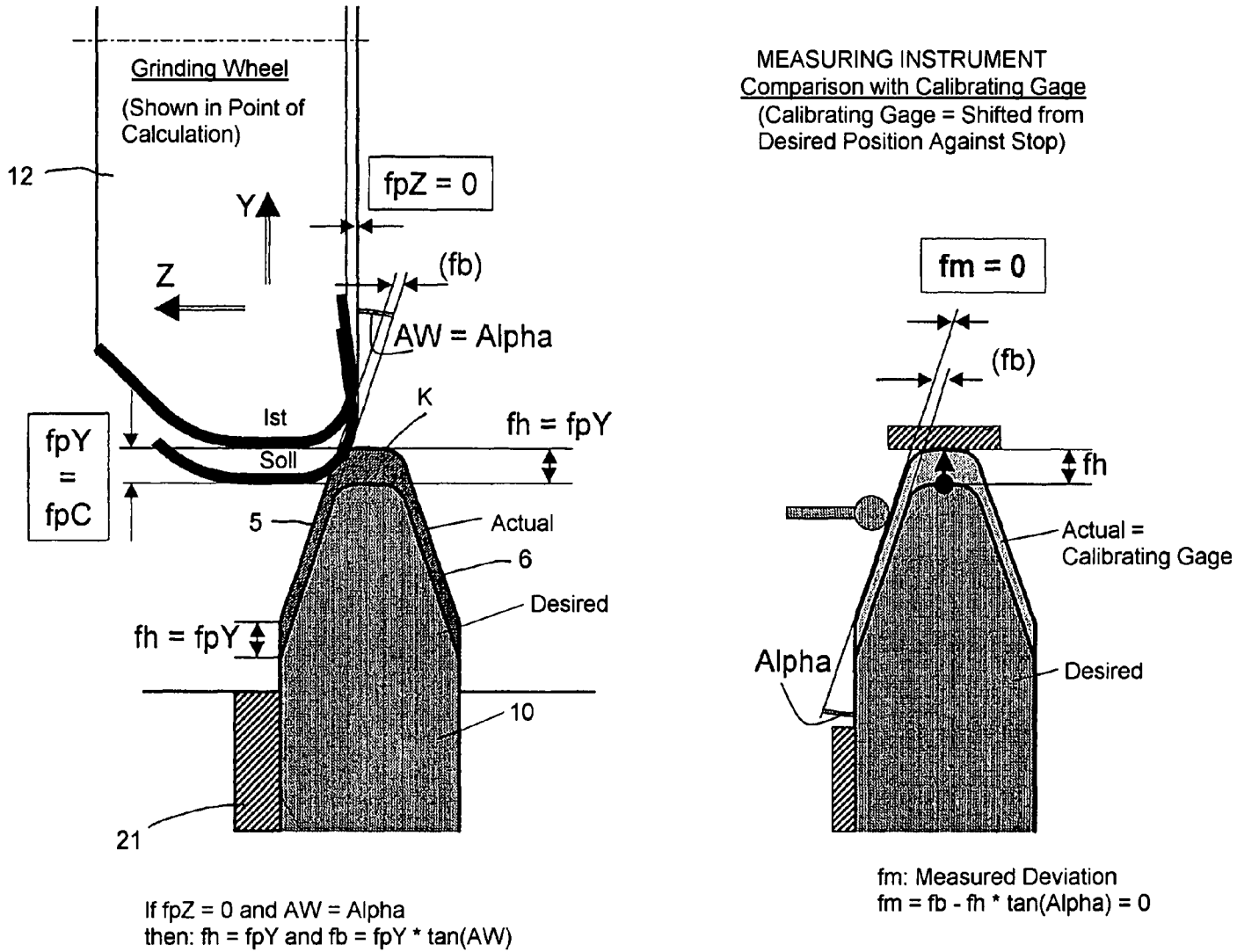
FIG. 8 shows the effect of the positional error in the direction of the blade shank.
Figure 9:
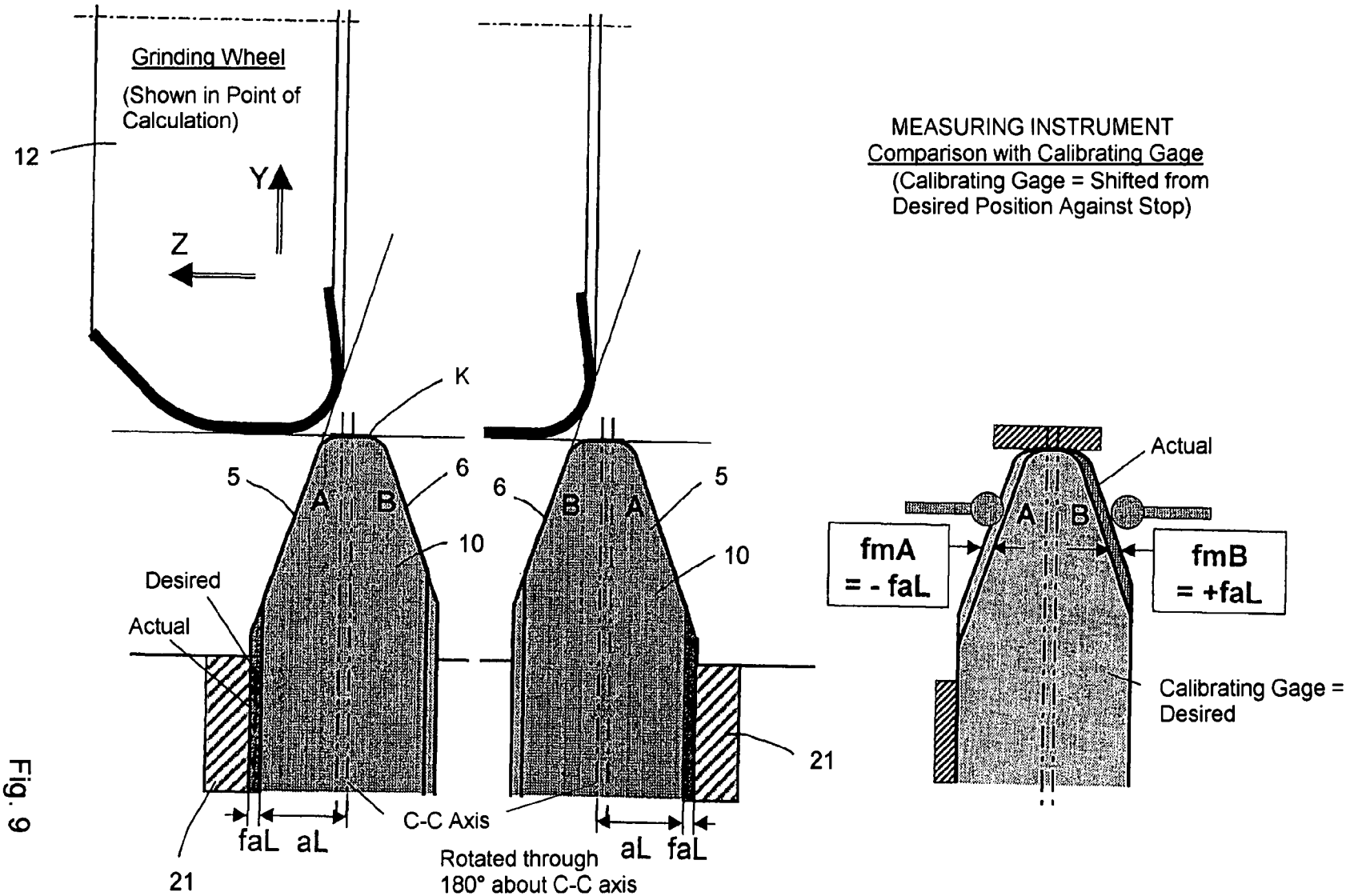
FIG. 9 shows the effect of a stop surface deviation when grinding the primary clearance surface A and the secondary clearance surface B of a bar cutting blade (left-hand cutting blade).

The basic idea of this calibrating method is to break down the cumulative error into individual components and compensate for them separately. This will be described in the following with reference to appended FIGS. 7 to 9.

When looking at only the component in the direction of the C—C axis (fpC in FIG. 7, corresponding to fpY in FIG. 8) of the position deviations (vector fp in FIG. 7) of the grinding wheel 12, it has the effect that top and flank are ground by the same offset amount (fh=fpY). When viewed in the shank direction of the cutting blade, only the abraded height changes, whilst the geometry of the finish-ground cutting blade is maintained unchanged. This effect is utilized to separate the individual errors as follows:

On orientation to the Y axis the measured deviation (fm) is equal to the Z component (fpZ), while on orientation to the Z axis it equals the Y component (fpY) of the position deviation. On condition that both flanks of the cutting blade were ground with the same direction of the C—C axis, the top edges exhibit the same offset, and the tip distances of the two flanks A and B the same deviation (fmA=fmB). Superimposed is the stop surface deviation (fa=faL or faR). It produces a positive deviation on one flank, and a negative deviation on the other flank (FIG. 9), but no offset of the top edges. Stop and position deviations can then be separated by computing difference and average (as described further below).

For the second position component the cutting blade has to be ground again. This can also be done on a change to the second stop surface. Although the cutting blade has to be ground and measured twice, a very simple and effective calibrating method is obtained.

To calibrate the wheel position, deviations (f=actual value·nominal value) are determined which are used for adjusting the nominal values forming the basis for calculation of the grinding path to the actual values (not vice versa!).

right-hand stop (difference) $faR=(fsB-fsA)/2$ for right-hand cutting blades left-hand stop (difference) $faL=(fsB-fsA)/2$ for left-hand cutting blades

*Z* position (average) $fpZ=(fsB+fsA)/2$ for *Y* orientation (end face)

*Y* position (average) $fpY=(fsB+fsA)/2$ for *Z* orientation (cylinder face)

Figure 10:
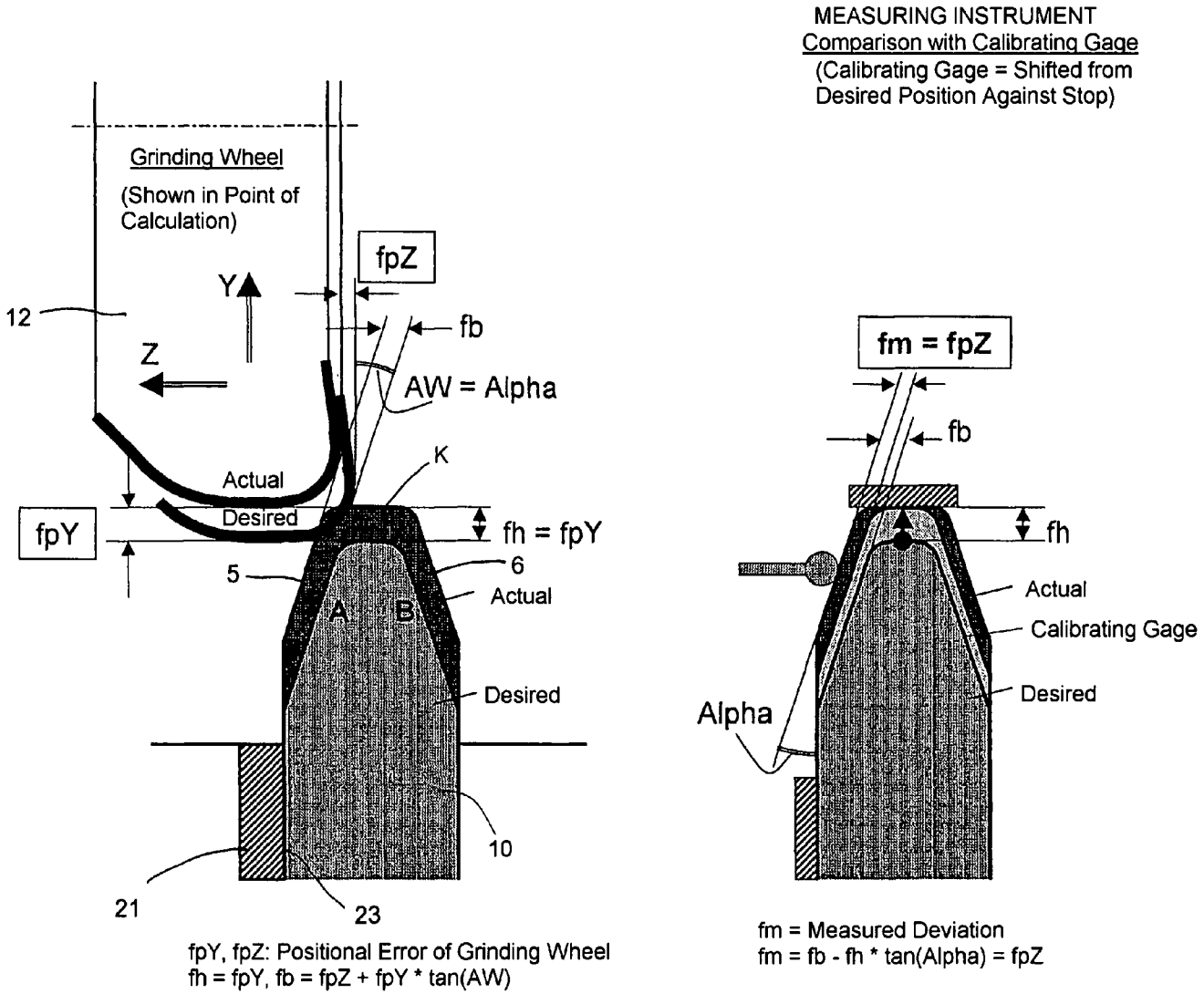
FIG. 10 shows a first calibrating grind, end face, to compensate for a measured deviation fm fpZ.
Figure 11:
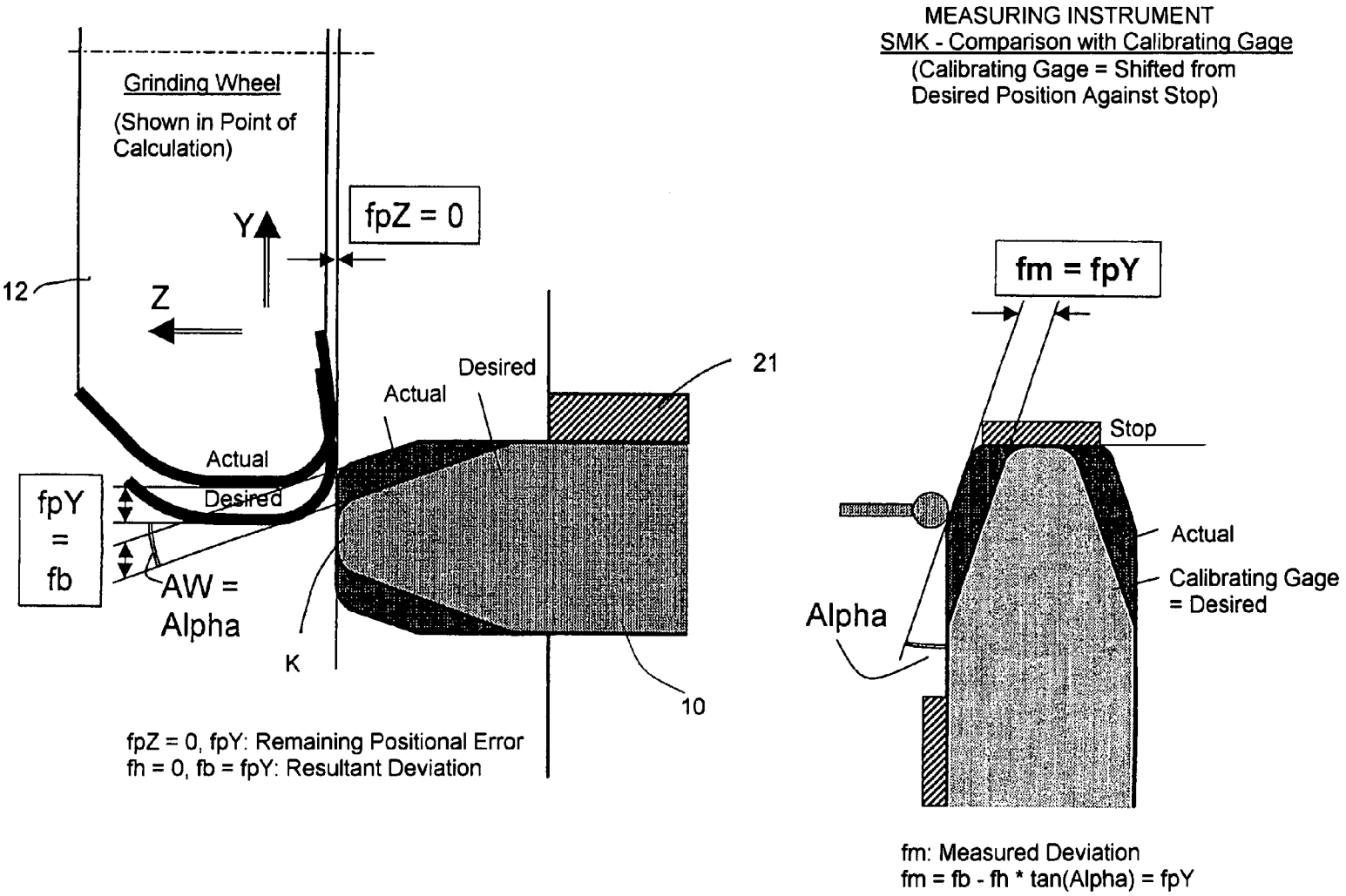
FIG. 11 shows a second calibrating grind, cylinder-face, to compensate for a measured deviation fm=fpY after deviation fpZ has been compensated for in accordance with FIG. 10.

In the method of the invention the calibration of a grinding wheel includes completely grinding the bar cutting blades 10 at least twice. Each calibrating grind comprises two finishing passes, which will be described in more detail in the following with reference to FIGS. 10 and 11.

First Calibrating Grind (Y Orientation, FIG. 10):

For the first finishing pass the bar cutting blade 10 is positioned against the end face of the grinding wheel 12 in such a manner that the A—A axis is as parallel to the Y axis as possible and the stop surface 23 of the clamping fixture 21 is precisely parallel to the X axis. In the first finishing pass the top surface K, a transition radius and the first flank are ground in a single pass.

For the second finishing pass the bar cutting blade is rotated about the C—C axis through 180 degrees by means of the clamping fixture 21, with the same grinding operation being repeated, so that again the top surface K, another transition radius and the second flank are ground.

In this process, the grinding wheel 12 is guided along the edges in such a manner that the top surface K is vertical, both flanks 5, 6 are opposite at a predetermined angle, preferably of 20 degrees, to the C—C axis, and the tips of the cutting blades are spaced from the stop surface 23 or 24 by the distances mA and mB to be checked.

In cases where a dual grinding wheel is used, design reasons require that in the method of the invention the C—C axis be tilted by a small angle. Together with the abrasion deviation of the facet, a feedback occurs between the Y and the Z component in the first calibrating step, which may produce a residual error (between about 5% and about 20% of the second component). In the event of major deviations, a check grind with recalibration, if applicable, should therefore be made. An offset of the top edges is avoided by grinding both flanks with the same axis arrangement.

Using the dual method, the edges are preferably ground to the same facet as the production blades. In the first finishing pass a large allowance over head has to be abraded which may produce a form error of the top edge. This error is however eliminated in the second finishing pass.

Second Calibrating Grind (Z Orientation FIG. 11):

The procedure is precisely the same as for the first grind, except that the cutting blade is positioned against the cylinder face of the grinding wheel by swinging the clamping fixture about the A—A axis through 90 degrees, as a result of which the C—C axis is parallel to the Z axis. Between the first and the second calibrating grind, changing between right- and left-hand stop is possible. Evaluation is performed in the manner initially described, by determining deviations (f=actual value·nominal value) for calibration of the wheel position, which deviations are used for adjusting the nominal values forming the basis for calculation of the grinding path to the actual values, similar to the prior art, with differences and averages being likewise calculated in the manner initially described.

After the wheel position is calibrated accurately, the essential dimensions of the grinding wheel can be checked and adjusted, where applicable.

Radius of Curvature Rg:

The bar cutting blade 10 is ground a third time, with the C—C axis being tilted through the flank angle, causing the flank to be in a vertical position. The measured deviation results in a third circle point from which the radius deviation can be computed by means of a suitable program.

Distance to Roughing Face Ps:

In another grinding pass the second flank is only rough-ground, without facet angle. The first flank serves a checking function. Evaluation is again performed by means of a suitable program.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A method of calibrating a grinding machine for the sharpening of bar cutting blades by grinding at least two flanks and a top surface of the bar cutting blades, comprising the steps of:

producing a calibrating blade by sharpening a bar cutting blade to a predetermined geometry, by completing grinding, at least twice, flanks defined by the bar cutting blade as well as a top surface of the bar cutting blade;

measuring the geometry of the calibrating blade on a measuring device outside of the grinding machine; and calibrating the machine with the aid of the measured geometry.

2. The method according to claim 1, wherein each grinding step is a calibrating grind and includes two finishing passes.

3. The method according to claim 2, wherein the two calibrating grinds involve the step of orienting the bar cutting blade in two axis directions (Y, Z), forming an angle of between about 70° and about 90° with one another in order to determine a position of a working face of a grinding wheel of the grinding machine relative to the two axis directions and the orientation of the bar cutting blade relative to a positioning axis (C—C).

4. The method according to claim 3, wherein a first finishing pass comprises grinding the top surface, a first transition radius to a first flank and the first flank in a single pass, whereupon the bar cutting blade is rotated about the positioning axis (C—C) through about 180 degrees, and a second finishing pass comprises grinding the top surface, a second transition radius to a second flank, and the second flank.

5. The method according to claim 4, wherein for the first calibrating grind the bar cutting blade is positioned against an end face of the grinding wheel.

6. The method according to claim 5, wherein for the second calibrating grind the bar cutting blade is swung through an angle of about 90 degrees and is positioned against a cylinder face of the grinding wheel.

7. The method according to claim 3, wherein for determining a radius of curvature (Rg) defined by a grinding wheel of the grinding machine the positioning axis (C—C) of the bar cutting blade is tilted through a flank angle and the bar cutting blade is completely ground on flanks defined by the bar cutting blade and the top surface using a third calibrating grind.

8. The method according to claim 2, further comprising the step of grinding one of two flanks of the bar cutting blade only with a roughing face of the grinding wheel, the position of which is to be determined.

9. The method according to claim 1, wherein that the step of measuring the geometry of the calibrating blade involves the use of an absolute measuring device.

10. The method according to claim 1, wherein that the step of measuring the geometry of the calibrating blade involves the use of a comparative measuring device that compares the measured geometry of the calibrating blade with the dimensions of a calibrating gage.

11. The method according to claim 1, wherein grinding of the bar cutting blade is performed under the same conditions under which bar cutting blades are sharpened on the grinding machine.

* * * * *